United States Patent [19]

Kahn

[11] 4,239,074

[45] Dec. 16, 1980

[54] CARRYING CASE

[75] Inventor: Ralph J. Kahn, Elkins Park, Pa.

[73] Assignee: Schlesinger Brothers, Inc., Camden, N.J.

[21] Appl. No.: 74,227

[22] Filed: Sep. 10, 1979

[51] Int. Cl.[3] ..... A45C 3/02; A45C 13/36

[52] U.S. Cl. ..... 150/1.6; 150/30; 190/50

[58] Field of Search ..... 150/1.6, 29, 30, 31; 190/49, 50, 54

[56] References Cited

U.S. PATENT DOCUMENTS

| | | | |
|---|---|---|---|
| 1,641,871 | 9/1927 | Solomon | 150/1.6 |
| 2,039,913 | 5/1936 | Lifton | 150/1.6 |
| 2,173,120 | 9/1939 | Lifton | 150/1.6 |
| 2,249,905 | 7/1941 | Lifton | 150/1.6 |

*Primary Examiner*—Donald F. Norton

*Attorney, Agent, or Firm*—Seidel, Gonda, Goldhammer & Panitch

[57] ABSTRACT

A carrying case, such as a briefcase, is disclosed with the side panels having U-shaped metal reinforcement. The metal reinforcement is encased in preformed sleeves made from lining material. The metal reinforcement is secured to the inner surface of the rectangular side panels by stitching.

7 Claims, 6 Drawing Figures

CARRYING CASE

BACKGROUND

The field of carrying cases includes briefcases, luggage, ladies handbags, etc. When carrying cases are made of fine leather, the carrying case needs internal reinforcement unless the leather is very thick. The reinforcement must be designed so as not to be visually apparent on the inside of the carrying case when the carrying case is opened.

It is known from U.S. Pat. No. 2,249,905 to provide a U-shaped metal reinforcement strip on the inner surface of side panels of a brief case. The structural interrelationship of the components of the brief case in said patent do not lend themselves to high speed efficient manufacturing methods. The present invention is directed to recognition of that problem and solution of the problem.

SUMMARY OF THE INVENTION

The present invention is directed to a carrying case which has side panels connected to end panels and a bottom panel connected to the lower edges of the side panels. Handle means are connected to the upper end portion of one of the panels such as the side panels. Each of the side panels is provided with a U-shaped metal reinforcement strip. A separate preformed sleeve is provided on the bight portion and the leg portions of the reinforcement strip. Each sleeve has an extension. Each extension is secured to the inner surface of its associated side panel.

In the preferred embodiment of the present invention, the U-shaped metal reinforcement strip is comprised of three discrete elements with each leg portion being pivotably connected to its bight portion. This facilitates rapid preassembly of the reinforcement strip by telescoping a preformed sleeve over each portion of the reinforcement strip.

It is an object of the present invention to provide a carrying case which is reinforced on the inner surface of its side panels in a manner which is attractive, provides sufficient strength for the side panels, and which facilitates efficient production methods.

Other objects will appear hereinafter.

For the purpose of illustrating the invention, there is shown in the drawings a form which is presently preferred; it being understood, however, that this invention is not limited to the precise arrangements and instrumentalities shown.

Figure 1:
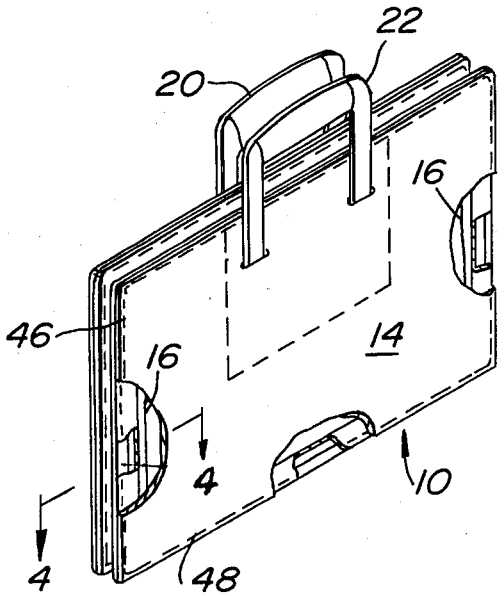
FIG. 1 is a perspective view of a carrying case in accordance with the present invention.

Referring to the drawings in detail, wherein like numerals indicate like elements, there is shown in FIG. 1 a carrying case in accordance with the present invention designated generally as 10. For purposes of illustrating the present invention, the carrying case 10 is a briefcase.

The carrying case 10 includes side panels 12 and 14 connected to end panels 16 as will be made clear hereinafter. Likewise, the side panels 12 and 14 are connected to a bottom panel 18. A zipper or other closure means is attached to the inner surface of the upper end of the side panels 12 and 14. One or more of the panels such as the side panels 12 and 14 may be provided with a handle means designated 20 and 22.

Each of the side panels 12 and 14 are provided with a U-shaped reinforcement strip designated generally as 24 and 26, respectively. Each of the strips 24 and 26 are identical. Hence, only strip 26 will be described in detail.

Figure 2:
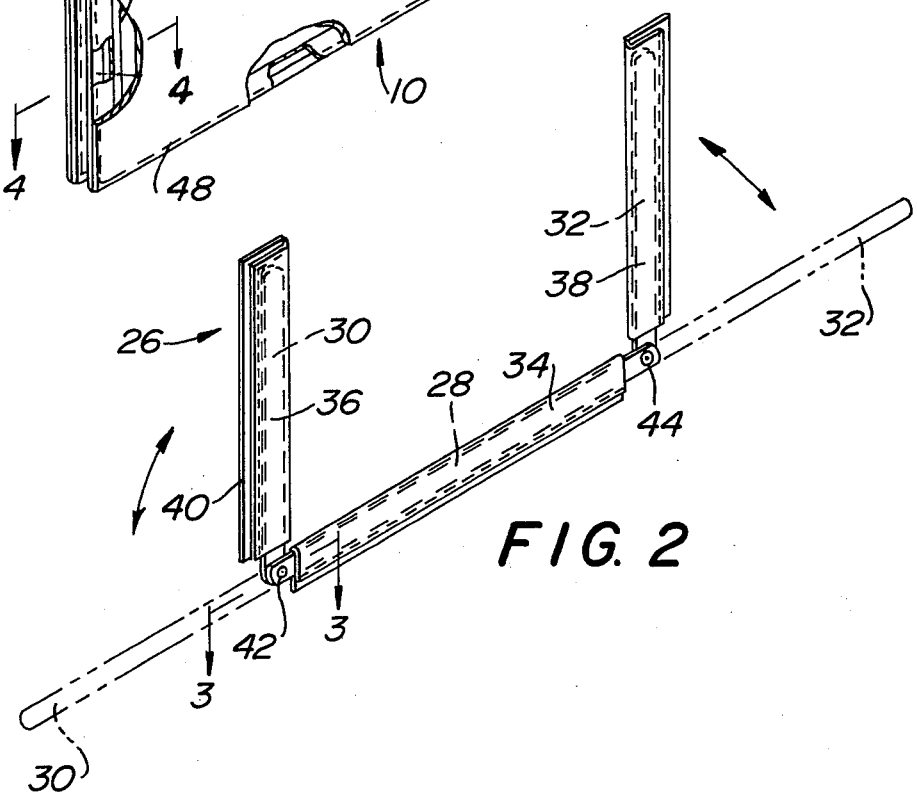
FIG. 2 is a perspective view of a U-shaped reinforcement.

Referring to FIG. 2, the U-shaped reinforcement strip 26 includes metal reinforcement members comprising a bight portion 28 and leg portions 30, 32 all preferably made of spring steel. A discrete preformed sleeve is telescoped over each of the portions 28, 30 and 32. Each sleeve is made from a lining material such as imitation leather. Each sleeve is shorter than its associated metal reinforcement portion and is preformed by being sewn so as to have a tab or extension 40 along one entire edge.

Figure 3:
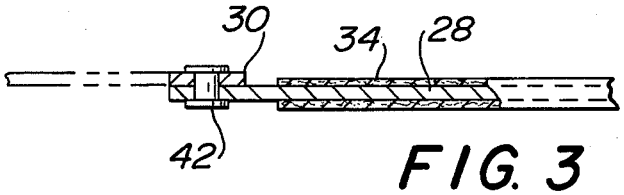
FIG. 3 is a sectional view taken along the line 3—3 in FIG. 2.

Since the sleeves are shorter than their associated metal reinforcement portion, adjacent ends of the bight portion 28 and leg portions 30, 32 may be joined together. The preferred joint is a pivotable joint wherein the ends are connected together by a pivot 42 or 44. As shown more clearly in FIG. 3, the pivot 42 is defined by a rivet or eyelet extending through aligned holes in the adjacent ends of the metal members 28 and 30. The pivots facilitate moving the leg portions to their phantom position as shown in FIG. 2 whereby the preformed sleeves may be telescoped one after the other onto the reinforcement strip 26 thereby providing a preassembled strip which may be combined with the panels to form the carrying case 10 in an efficient manner.

Figure 4:
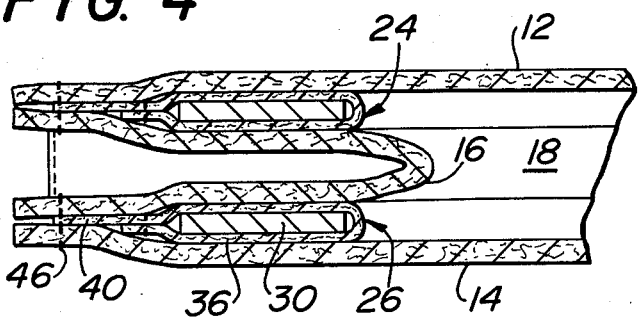
FIG. 4 is a sectional view taken along the line 4—4 in FIG. 1.

Stitches 46 are utilized to join the end panel or gusset 16, the extension 40 on sleeve 36, and the side panel 14. Sleeve 38 is joined to panels 14 and 16 in a similar manner. Stitches 48 are utilized to secure an end portion of the bottom panel 18, the extension on sleeve 34, and the side panel 14. See FIGS. 1 and 4. Sleeves 36 and 38 are closed at their upper end so that the metal strip therewithin is not visible. When the carrying case 10 is opened, the reinforcement strips acts as a decoration and the sleeves 34, 36 and 38 appear to be one continuous sleeve. The reinforcement strip 24 is similarly processed and assembled. Since the reinforcement strips 24, 26 are preformed, little assembly skill is required to construct the carrying case 10. Since the extensions 40 are the portions of the reinforcement strip to be stitched or otherwise secured to the inner surface of the side panels, there is little chance of breaking a sewing needle by contact with the metal portions (28, 30, 32) of the reinforcement strip 26.

Figure 5:
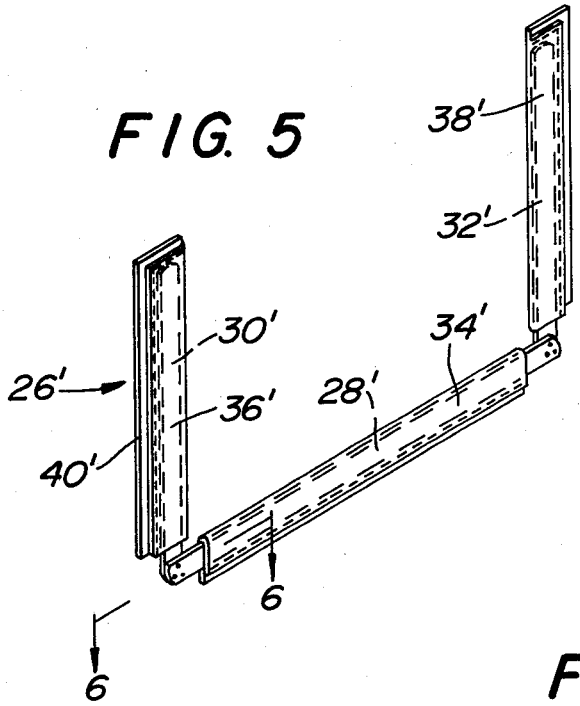
FIG. 5 is a perspective view of an alternative embodiment of a reinforcement strip.
Figure 6:
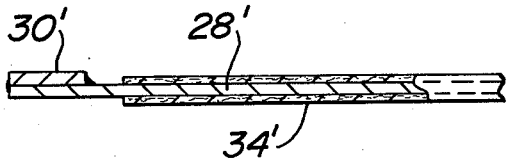
FIG. 6 is a sectional view taken along the line 6—6 in FIG. 5.

In FIGS. 5 and 6, there is illustrated another embodiment of the U-shaped reinforcement strip which may be utilized in accordance with the present invention. The alternative embodiment is designated 26' and is the same as strip 26 except as will be made clear hereinafter. Hence, corresponding elements are provided with corresponding primed numerals.

The metal reinforcement in the bight portion 28' is a separate discrete element as compared with the leg portions 30' and 32'. This feature is the same as strip 26.

However, the bight portion 28' has its ends welded or otherwise fixedly secured to the leg portions 30' and 32'. Prior to such securement of the ends, a preformed sleeve 34' is telescoped over the bight portion 28'. Thereafter, the leg portions 30' and 32' are welded or otherwise secured to the exposed free end portions of the bight portion 28. Thereafter, the sleeves 36' and 38' are telescoped over their associated leg portions 30' and 32', respectively.

The carrying case of the present invention may be made with a metal member encased in a preformed sleeve and having each end fixed to one of the ends of the leg portions of U-shaped strips 26, 26'.

As a result of the structural interrelationship of the components, the carrying case 10 may be made with a minimum number of materials with the components being preformed so as to facilitate rapid assembly with minimum skill being required. The resultant carrying case is attractive and sufficiently strong for its intended purpose, and the carrying case 10 will not collapse on usage.

The present invention may be embodied in other specific forms without departing from the spirit or essential attributes thereof and, accordingly, reference should be made to the appended claims, rather than the foregoing specification, as indicating the scope of the invention.

I claim:

1. A carrying case comprising side panels, end panels connected to the side panels, a bottom panel connected to the lower edges of the side panels, handle means connected to the upper end portion of some of said panels, a U-shaped metal reinforcement strip for each of said side panels, a separate preformed sleeve on each of the bight portion and leg portions of said reinforcement strips, each sleeve having an extension along one edge thereof, and means securing each extension to the inner surface of one of said side panels, said means also securing each extension to an adjacent one of the end and bottom panels.

2. A carrying case in accordance with claim 1 wherein the reinforcement strips have leg portions pivotably connected to the bight portion.

3. A carrying case in accordance with claim 1 wherein the sleeves are shorter than the length of their associated portion of the reinforcement strip, and the sleeves being made from a lining material.

4. A carrying case in accordance with claim 1 wherein each reinforcement strip is made from three discrete pieces of metal.

5. A carrying case in accordance with claim 1 wherein the sleeves on the leg portions are closed at the terminal free end of the leg portions.

6. A carrying case comprising side panels, end panels connected to the side panels, a bottom panel connected to the lower edges of the side panels, handle means connected to the upper end portion of some of said panels, a metal reinforcement strip for each said side panels, each reinforcement strip having at least three leg portions with two of the leg portions being generally parallel to each other and generally perpendicular to the third leg portion, a separate preformed sleeve on each of said leg portions of said reinforcement strips, each sleeve having an extension along one edge thereof, the sleeves being shorter than the length of their associated leg portion, the sleeves being made from a lining material, and means securing each extension to the inner surface of one of said panels.

7. A carrying case in accordance with claim 6 wherein said two leg portions are pivotably connected to said third leg portion.

* * * * *